United States Patent [19]

Auge

[11] 4,184,097

[45] Jan. 15, 1980

[54] INTERNALLY SHIELDED X-RAY TUBE

[75] Inventor: Charles W. Auge, Placentia, Calif.

[73] Assignee: Magnaflux Corporation, Chicago, Ill.

[21] Appl. No.: 914,166

[22] Filed: Jun. 9, 1978

Related U.S. Application Data

[63] Continuation-in-part of Ser. No. 771,849, Feb. 25, 1977.

[51] Int. Cl.[2] ..... H01J 35/08; H01J 35/16

[52] U.S. Cl. ..... 313/55; 313/330

[58] Field of Search ..... 313/55, 57, 330; 250/520

[56] References Cited

U.S. PATENT DOCUMENTS

| | | | |
|---|---|---|---|
| 2,332,422 | 10/1943 | Zunick | 313/55 |
| 2,490,246 | 12/1949 | Zunick | 313/330 |
| 2,836,749 | 5/1958 | Atlee | 313/55 X |
| 2,903,611 | 9/1959 | Raine | 313/330 X |
| 2,909,686 | 10/1959 | Zunick | 313/55 X |

*Primary Examiner*—Palmer C. Demeo

*Attorney, Agent, or Firm*—Hill, Van Santen, Steadman, Chiara & Simpson

[57] ABSTRACT

An X-ray tube having internal shielding and producing less external stray radiation comprising an evacuated envelope, an X-ray generating target within the envelope, an electron gun positioned within the envelope to direct a stream of electrons at the target, a window arranged to direct the resulting X-rays through the envelope, high density attenuating means located within the envelope and substantially surrounding the target to attenuate high energy photons which do not exit through the window means, and a lower density metal covering about at least a portion of the high density attenuating means in order to reduce the intensity of secondary X-ray emission from the high density attenuating means.

8 Claims, 3 Drawing Figures

Fig. 1
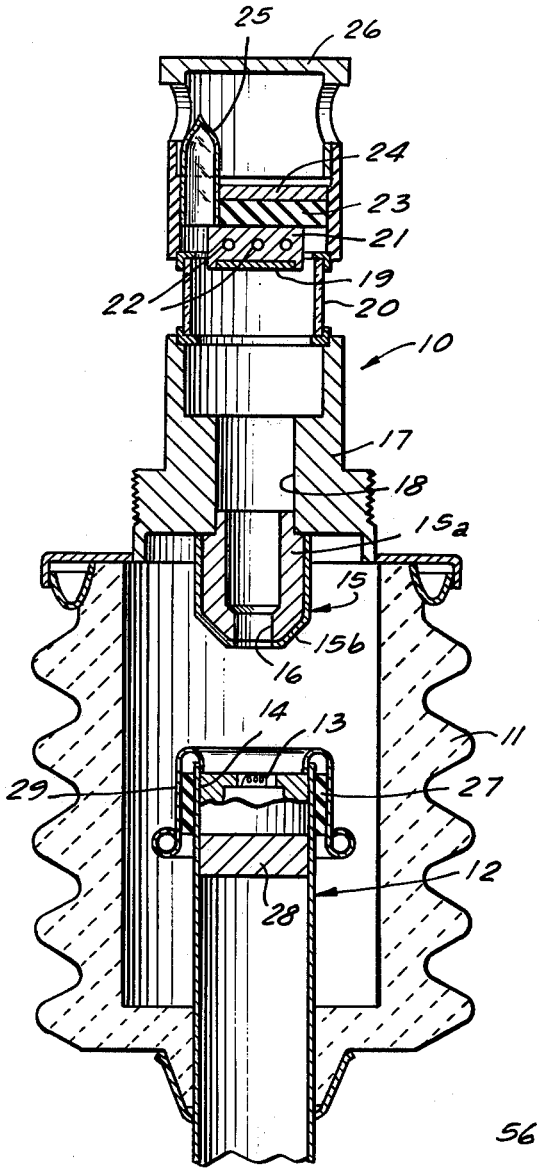
Fig. 2
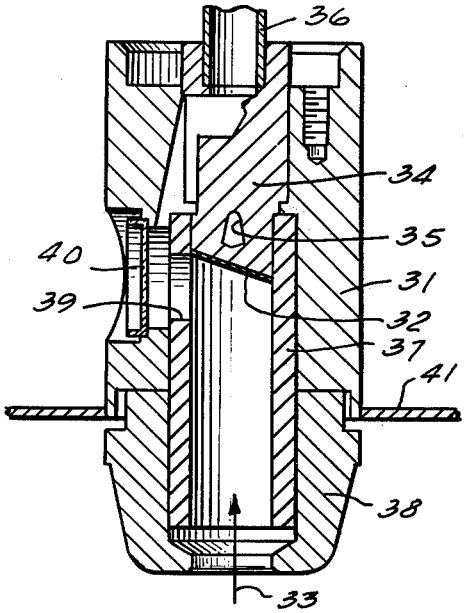
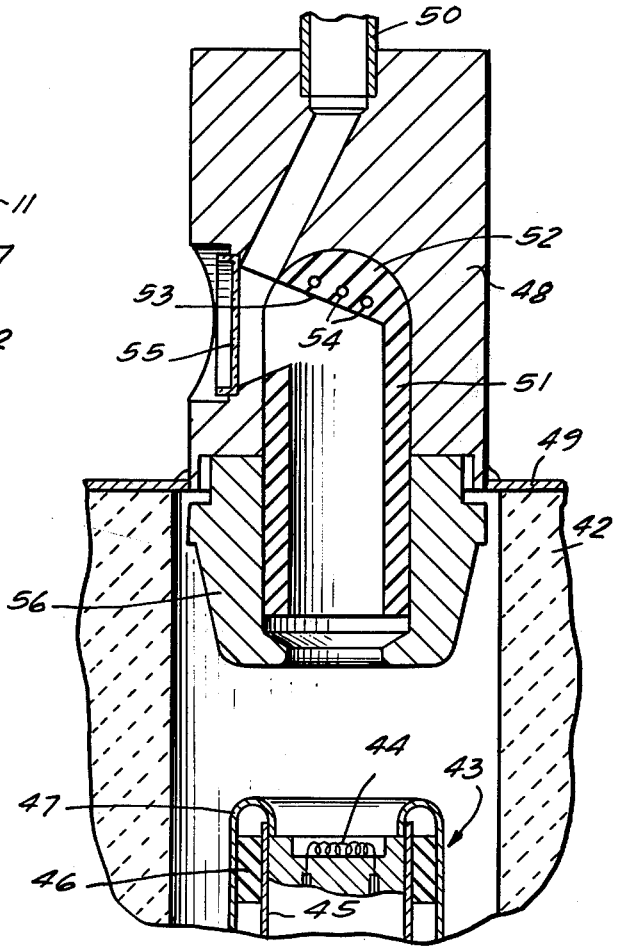
Fig. 3

INTERNALLY SHIELDED X-RAY TUBE

REFERENCE TO RELATED APPLICATION

This application is a continuation-in-part of my copending application Ser. No. 771,849 filed Feb. 25, 1977.

BACKGROUND OF THE INVENTION

1. Field of the Invention

This invention is in the field of internally shielded X-ray tubes wherein a high density attenuating means is located in proximity to the path of electrons emanating from the electron gun of the tube and also at or near the target area thereby reducing the need for large amounts of external shielding. Problems inherent in secondary X-ray emission from such high density attenuating means are reduced by providing a lower density shielding about the high density attenuating means.

2. Description of the Prior Art

In any X-ray tube, X-rays are produced by accelerating electrons to a high velocity by means of an electrostatic field and then suddenly stopping them by collision with a solid target interposed in their path. The X-rays which result radiate in all directions from the spot from the target where the collisions take place. The X-rays are due to the mutual interaction of the fast moving electrons with the electrons and the positively charged nuclei which constitute the atoms of a target.

The first high vacuum X-ray tube used a hot tungsten filament cathode and a solid tungsten target. This hot cathode, high vacuum type of X-ray tube permitted stable and reproducible operation with relatively high voltages and large masses of metals. The vacuum was sufficiently good so that positive ions did not play either an essential or a harmful role in the tube operation.

Notwithstanding the wide acceptance of such high vacuum X-ray tubes in recent years, these tubes still have stray radiation problems resulting from high energy photons which are generated at the target and which do not find their way out of the envelope through the window. Consequently, it has become common practice to use large amounts of external shielding to attenuate these X-ray photons outside of the evacuated envelope. The necessity of such shielding significantly increases the cost and the bulk of the X-ray tube.

Some efforts have been made to employ anode shields or hoods consisting of a tubular type member which surrounds the target in an attempt to cut off any stray X-ray beams from particularly low voltage tubes. Such a hooded tube is described in Atlee U.S. Pat. No. 2,754,514.

The advantages of the hooded structure are somewhat reduced by the fact that secondary electrons in an operating tube intercept the anode hood and generate undesirable X-rays. When the hood is made of a high density material, these X-rays are more energetic and require much more external shielding.

SUMMARY OF THE INVENTION

The present invention provides a means for reducing the amount of external shielding required for high vacuum X-ray tubes by means of internal shielding, and simultaneously reduces the harmful effects of undesirable X-rays generated by secondary electrons. The improved X-ray tubes of the present invention include an evacuated envelope in which there is located an X-ray generating target and an electron gun positioned to direct a stream of high velocity electrons at the target. A high density attenuating means is provided within the envelope both along the path of electron passage from the electron gun to the target and also behind the target. In both cases, the high density attenuating means is covered by a coating or a more massive covering of a low density metal having an atomic number less than 40 and having a melting point which is in excess of the operating temperature of the tube.

In one form of the invention, the target is substantially perpendicular to the stream of electrons and the high density attenuating means is positioned coaxially with the stream and also behind the target. In another form of the invention the target is positioned at a small angle to the horizontal and the high density attenuating means is positioned along the path of the stream of electrons and also behind the target. In a further modified form of the invention, the target means and the high density attenuating means are part of the same integral structure.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which:

FIG. 1 is a vertical cross-sectional view of one form of X-ray tube can be used in accordance with the present invention;

FIG. 2 is a fragmentary cross-sectional view of a target area of a modified form of the present invention; and FIG. 3 is a partial cross-sectional view of still another form of the invention wherein the target area and the shielding means are integral with each other.

DESCRIPTION OF THE PREFERRED EMBODIMENTS

In FIG. 1, reference numeral 10 indicates generally an improved X-ray tube according to the present invention having a solid ceramic insulator base 11 through which there extends an electron gun generally indicated at reference numeral 12. The electron gun 12 includes a heated filament 13 for generating electrons, and a focusing electrode 14 which directs a stream of such electrons toward an anode assembly including an X-ray attenuating anode tip 15 having an axial bore 16 through which the beam of electrons is passed. The anode assembly also includes an anode body 17 having an axial bore 18 in registry with the bore 16 to direct the beam of electrons toward a target 19 composed of a heavy metal or heavy ceramic of high atomic weight. As is well known in the art, any target material should have a high atomic number to give the best X-ray efficiency, a high melting point and high thermal conductivity to permit maximum energy for a given size of focal spot, and a low vapor pressure to reduce the rate of evaporation of the metal on the walls of the ceramic envelope.

The anode tip 15 is actually composed of a combination of a high density attenuating metal core **15*a* and a lower density coating 15*b* composed of nickel, copper, or the like. It has been found that if the anode tip 15*a* is left exposed, the secondary electron emission which is unavoidable in the tube causes generation of X-rays at relatively high energy levels, which X-rays are relatively diffuse and tend to fog photographic plates. A provision of the coating 15b, while it may produce some secondary X-rays, does so at a lower energy level since the wavelength is much lower, thereby requiring less external shielding to achieve very low stray radiation levels. The coating 15b** is composed of a metal having an atomic number less than 40, having a melting point below the operating temperature of the tube, and evidencing little or no outgassing at the operating pressure of the X-ray tube which is typically on the order of $1\times10^{-9}$ torr.

The core 15a as well as the anode body 17 are composed of a high density X-ray attenuating material such as tungsten, tantalum, depleted uranium, zirconium or an attenuating ceramic material such as uranium oxide.

The high energy electron beam striking the target 19 causes X-ray radiation in all directions from the spot on the target where the collisions take place. The X-ray tube of FIG. 1 is provided with a window 20 composed of a material such as beryllium or a ceramic which is transparent to X-ray radiation and through which the X-rays can leave the confines of the tube to the area at which they are used. Regardless of the spatial orientation of the target area and the window, however, there is unavoidably some X-ray radiation back into the bore 18 from behind the target 19, and even back into the electron gun assembly. For tubes operating at a reasonably high power level, it is desired to use a composite of attenuating material and a good heat conductor such as copper. Such a composite is illustrated at FIG. 1 where the target 19 is shown backed by a copper layer 21 having cooling passages 22 formed therein. The copper is in turn backed by an attenuating layer 23 composed of one of the aforementioned high density attenuating compositions. An additional copper layer 24 is formed over the attenuating layer 23. An exhaust tube 25 is confined within the target backing 23. The exhaust tube 25 is used to evacuate the interior of the tube to a high vacuum whereupon it is sealed by closing off the end of the copper tube and covered with a tube cap 26.

Stray radiation which proceeds far enough to strike the electron gun assembly 12 is attenuated by means of a ring 27 and a disc 28 composed of a high density X-ray attenuating material and surrounding the focusing electrode 14. The ring 27 and the disc 28 are in turn confined within a housing 29 composed of nickel, copper, or one of the other low atomic number metals. Thus in the tube of FIG. 1, wherever there is possibility of secondary electrons striking metal which could generate undesirable high energy X-rays, there is interposed a layer or a solid block of the lower density metal. When secondary X-rays are generated by such lower density metals, they are not at the same energy level because their wavelength is much lower, so that they require less external shielding to achieve very low stray radiation levels.

In the form of the invention shown in FIG. 2, there is provided an anode housing 31 composed of copper or other highly heat conductive material. A target structure consisting of a target plate 32 is disposed at a small angle to the horizontal with respect to the electron beam which is directed at it in the direction of the arrow 33. The target 32 is supported on a target support 34 composed of copper, a copper attenuating material composite or one of the aforementioned high density attenuating materials. One or more fluid flow passages 35 is provided in the target support to cool the target structure during operation. A line 36 is provided to connect the interior of the tube assembly to a source of high vacuum (not shown).

The target 32 is substantially surrounded by a sleeve 37 composed of a high density attenuating material such as tungsten, tantalum, depleted uranium, zirconium, or uranium oxide. The lower end of the sleeve 37 is received in snug fitting engagement with a support 38 composed of one of the aforementioned low density materials such as nickel or copper. The sleeve 37 is provided with an aperture 39 along a relatively limited portion of its circumference to provide for egress of the X-rays generated by the electron beam striking the target 32. An X-ray pervious window 40 directs the X-ray radiation out of the tube to its point of use. A mounting flange 41 is provided to mount the anode structure onto a ceramic insulator of the type shown in FIG. 1.

A further modified form of the invention is illustrated in FIG. 3. In this form of the invention there is provided a high density zirconium or uranium oxide ceramic insulator 42 in which there is disposed an electron gun 43 including a heated filament 44 and a focusing electrode 45. A ring 46 of relatively high density, X-ray attenuating material surrounds the focusing electrode 45 and the filament 44. The entire electron gun assembly is encased in a shell 47 composed of a relatively low density material such as nickel or copper from which secondary X-rays, when generated, are already at low energy levels.

The anode structure in the embodiment shown in FIG. 3 takes the form of an anode body member 48 composed of copper or the like and having a flange portion 49 for mounting against the ceramic insulator 42. A line 50 communicates the interior of the X-ray tube to a source of vacuum.

As shown in FIG. 3, the target and the shield are part of the same integral structure consisting of a cylindrical portion 51 surrounding the path of electron flow from the electron gun 43 and terminating in a generally spherical head 52 in which there is provided an inclined target face 53. Cooling passages 54 are provided in this portion of the anode to abstract heat from the target area. A window 55 directs the X-ray radiation from the target area 50 outwardly. The lower end of the cylindrical portion 51 of the anode structure is encased in an anode tip 56 composed of one of the aforementioned lower density metals having an atomic number less than 40. In the absence of the anode tip 56, there would be a substantial tendency for secondary emission to cause X-ray generation from the outer periphery of the cylindrical portion 51 from a resulting and stray X-ray field which could fog photographic film.

In any of the forms of the invention shown, the ceramic insulator itself can include attenuating oxides such as uranium oxide, zirconium oxide, or other high density, vacuum stable materials. The ceramic then absorbs secondary X-rays generated on the parts of the tube centered within the ceramic and still further reduces the stray radiation.

The improved X-ray tubes of the present invention reduce the cost of shielding and substantially reduce shielding weight for the same amount of stray radiation. Furthermore, from a product safety standpoint, the shielding is fail-safe as it cannot be removed without making the X-ray tube inoperative.

It should be evident that various modifications can be made to the described embodiments without departing from the scope of the present invention.

I claim as my invention:

1. An X-ray tube comprising an evacuated envelope, an X-ray generating target within said envelope, an electron gun positioned within said envelope to direct a stream of electrons at said target, window means arranged to direct the resulting X-rays beyond said envelope, high density attenuating means within said envelope having an axial bore in line with the direction of the electron stream and at least a substantial portion of its axial length extending into the space between said target and said electron gun to attenuate high energy photons not exiting through said window means and a metal having a lower density than said high density attenuating means covering about at least a portion of said high density attenuating means to reduce the intensity of secondary X-ray emission from said high density attenuating means, said lower density metal having an atomic number less than 40 and a melting point above the operating temperature existing in said tube.

2. An X-ray tube according to claim 1 where said high density attenuating means comprises tungten and said lower density metal is nickel.

3. An X-ray tube according to claim 1 in which said high density attenuating means comprises tungsten and said lower density metal is copper.

4. An X-ray tube according to claim 1 in which said target is substantinally perpendicular to said stream of electrons and said high density attenuating means is positioned also behind said target.

5. An X-ray tube according to claim 1 in which said lower density metal covering is a coating on said high density attenuating means.

6. An X-ray tube according to claim 1 in which said high density attenuating means is in the form of a sleeve and said sleeve is received within a holder composed of said lower density metal.

7. An X-ray tube according to claim 1 in which said target is positioned at a small angle to the horizontal and said high density attenuating means is positioned along a path of said stream of electrons and also behind said target.

8. An X-ray tube comprising an evacuated envelope, an X-ray generating target within said envelope, an electron gun positioned within said envelope to direct a stream of electrons at said target, said target being disposed at an acute angle to the electron beam path, window means arranged to direct the resulting X-rays from said target beyond said envelope, a sleeve composed of a high density attenuating material disposed about said target, said sleeve having an aperture therein permitting passage of X-rays from said target through said window means, high density attenuating means disposed behind and peripherally around said electron gun to attenuate stray high energy photons and a shield about said high density attenuating means composed of a metal having an atomic number less than 40 and a melting point above the operating temperature existing in said tube.

* * * * *